United States Patent [19]

Smith

[11] Patent Number: 4,722,442

[45] Date of Patent: Feb. 2, 1988

[54] DRIP SHIELD MEANS FOR USE WITH PAINT CANS

[76] Inventor: Elmer M. Smith, R.R.-2, Box 283, 391 Bear Tavern Rd., Titusville, N.J. 08560

[21] Appl. No.: 34,978

[22] Filed: Apr. 6, 1987

[51] Int. Cl.[4] ..... B65D 47/40; B65D 21/02

[52] U.S. Cl. ..... 206/515; 220/69; 220/85 R; 220/85 H; 220/406; 215/100.5; 206/813

[58] Field of Search ..... 206/515, 518, 813; 220/69, 85 R, 85 H, 406; 215/100.5

[56] References Cited

U.S. PATENT DOCUMENTS

| | | | |
|---|---|---|---|
| 693,514 | 2/1902 | Haberstroh . | |
| 864,556 | 8/1907 | Reiter . | |
| 1,910,484 | 5/1933 | Thompson . | |
| 2,131,878 | 10/1938 | Lawrence . | |
| 2,150,965 | 3/1939 | Doty . | |
| 2,163,309 | 6/1939 | McConnell . | |
| 2,518,214 | 8/1950 | Worthington | 220/69 |
| 2,542,413 | 2/1951 | Ibsch | 220/406 |
| 2,550,713 | 5/1951 | Nicholson . | |
| 2,630,241 | 3/1953 | Schnabel . | |
| 2,731,056 | 1/1956 | Anson | 215/100.5 |
| 2,744,624 | 5/1956 | Hoogstoel . | |
| 2,856,095 | 10/1958 | Schnabel . | |
| 3,013,688 | 12/1961 | Luning . | |
| 3,080,997 | 3/1963 | Brown . | |
| 3,352,450 | 11/1967 | Rawlins . | |
| 3,407,429 | 10/1968 | Nardo . | |
| 3,944,069 | 3/1976 | Eldridge | 206/813 |
| 4,071,163 | 1/1978 | Martin . | |
| 4,353,476 | 10/1982 | Cowgill . | |

*Primary Examiner*—George E. Lowrance
*Attorney, Agent, or Firm*—Sperry, Zoda & Kane

[57] ABSTRACT

A drip shield device, usable with paint cans of any conventionally available size, which includes a generally circular base section having an upper abutment surface defined thereon. A containment lip extends upwardly and outwardly with respect to the base section to define a paint containment chamber. A pressure-sensitive adhesive layer extends across at least a portion of the base section to allow detachable securement of the bottom edge of a paint can with respect to the upper abutment surface of the base section. The containment lip cooperates with the base section and the paint can to define a paint containment chamber to receive and retain paint spilled down the sides of the paint can. The drip shields are stackable with respect to similarly configured drip shields due to the pressure sensitive detachable adhesive which is adaptable to be secured to a paint can as well as to a lower abutment surface of a base section thereof.

8 Claims, 4 Drawing Figures

DRIP SHIELD MEANS FOR USE WITH PAINT CANS

BACKGROUND OF THE INVENTION

1. Field of the Invention

The present invention deals with the field of devices usable for preventing dripping or spilling of paint normally associated with paint cans which run down the sides thereof during usage. It is common with the usage of paint cans that paint drippings will run down the sides of the paint cans. The present device provides a means for containing this dripped or spilled paint in such a manner as to prevent it from contacting the floor or area surrounding the painting location.

2. Description of the Prior Art

A number of prior art devices have been utilized to facilitate clean-up operations in the area adjacent to where paint is being applied. Examples of such devices are U.S. Pat. No. 693,514 issued Feb. 18, 1902 to A. Haberstroh for an Adhesive Fastener; U.S. Pat. No. 864,556 issued Aug. 27, 1907 to E. C. Reiter for a Drip Pan; U.S. Pat. No. 1,910,484 issued May 23, 1933 to R. Thompson on a Bucket Shield; U.S. Pat. No. 2,131,878 issued Oct. 4, 1938 to A. L. Lawrence on a Coaster; U.S. Pat. No. 2,150,965 issued Mar. 21, 1939 to W. J. Doty on a Drip Tray For Paint Pots; U.S. Pat. No. 2,163,309 issued June 20, 1939 to P. B. McConnell on a Coaster; U.S. Pat. No. 2,550,713 issued May 1, 1951 to J. A. Nicholson on a Detachable Bucket Drip Pan; U.S. Pat. No. 2,630,241 issued Mar. 3, 1953 to F. C. Schnabel on a Drip Tray For Paint Cans; U.S. Pat. No. 2,744,624 issued May 8, 1956 to L. E. Hoogstoel et al on a Packaging Device; U.S. Pat. No. 2,856,095 issued Oct. 14, 1958 to F. C. Schnabel on an All Purpose Drip Tray And Plate; U.S. Pat. No. 3,013,688 issued Dec. 19, 1961 to A. O. Luning on Coasters - Magnetic; U.S. Pat. No. 3,080,997 issued Mar. 12, 1963 to T. G. Brown on a Disposable Ash Tray; U.S. Pat. No. 3,352,450 issued Nov. 14, 1967 to J. Rawlins on a Tray For Paint Can; U.S. Pat. No. 3,407,429 issued Oct. 29, 1968 to L. A. DiNardo on a Paint Can Apron And Brush Holder; U.S. Pat. No. 4,071,163 issued Jan. 31, 1978 to M. Martin on an Apparatus For Recovering Paint Spills; and U.S. Pat. No. 4,353,476 issued Oct. 12, 1982 to C. Cowgill on a Paint Applicator Holder.

SUMMARY OF THE INVENTION

The present invention provides a drip shield means for use with paint cans of any conventionally available size. These drip shield means are also preferably self-stacking with respect to one another to facilitate storage and shipment thereof.

Each drip shield means includes a base section being generally circular in shape and extending horizontally to define an upper abutment surface for contacting the bottom of a paint can for detachable securement with respect thereto. A pressure-sensitive adhesive is preferably positioned extending across the upper abutment surface of the base section to facilitate detachable securement of the bottom of the paint can with respect to the drip shield. This pressure-sensitive adhesive means further is detachably secured preferably with respect to the undersurface of another similarly configured drip shielf to facilitate stacking during storage or shipment.

A containment lip is attached circumferentially about the outermost edge of the base section in such a manner as to extend upwardly and outwardly with respect thereto to define a paint containment chamber for receiving and retaining paint which may run down the sides of the paint can during usage. The containment lip is in direct abutment with respect to the base section therearound to prevent loss of paint outwardly therebetween. To insure that there will be no loss of paint between the containment lip and the base section it is preferable that they are formed integral with respect to one another.

In order to enhance the feasibility of the drip shield of the present invention it is preferable that the base section and the containment lip be of a paper material such that individual shields are extremely inexpensive and are marketed as being disposable. Preferably the pressure-sensitive adhesive means will extend across the entire base section but it may also be desirable that the adhesive also extend somewhat onto the containment area in order to facilitate the securement of larger paint cans with respect to the drip shield. Further to facilitate the flow of spilled paint downwardly into the containment chamber it may be desirable to include vertical ribbing means to act as guide channels to urge movement of spilled paint downwardly into the bottom portion of the paint containment chamber.

Preferably each base section will also define a lower abutment surface which is adapted to be detachably secured with respect to the pressure-sensitive adhesive layer of another similarly configured drip shield in order to facilitate stacking thereof during storage prior to usage and during shipment. In certain configurations in order to insure the stacking capability and also to insure the adherence to paint cans of various sizes it may be necessary to extend the pressure-sensitive adhesive layer across the entire upper surface of both the base section and the containment lip.

It is an object of the present invention to provide a drip shield means for use with paint cans wherein detachable securement is made possible with any of the conventionally available sizes of such paint cans.

It is an object of the present invention to provide a drip shield means for use with paint cans wherein self-stacking of the drip shield with another similarly configured drip shield is made possible.

It is an object of the present invention to provide a drip shield means for use with paint cans wherein a base section is provided which is generally circular in order to facilitate abutment with circular paint cans.

It is an object of the present invention to provide a drip shield means for use with paint cans wherein an upper abutment surface is provided for contacting either the bottom of a paint can or the bottom of a similarly configured drip shield for stacking thereof.

It is an object of the present invention to provide a drip shield means for use with paint cans wherein the adhesive means applied as a layer over the upper portion of the base section is of a pressure-sensitive type.

It is an object of the present invention to provide a drip shield means for use with paint cans wherein attachment and detachment with respect to paint cans is facilitated by the pressure-sensitive attachable and detachable adhesive means utilized thereon.

It is an object of the present invention to provide a drip shield means for use with paint cans wherein a containment lip means cooperates with the base section to define a paint containment chamber extending about the bottom of the paint can area to receive and retain all paint drippings running down the outside surface of the individual paint can.

It is an object of the present invention to provide a drip shield means for use with paint cans wherein all portions thereof except for the adhesive layer are formed of a paper material in order to facilitate the marketing thereof as being disposable.

It is an object of the present invention to provide a drip shield means for use with paint cans wherein ribbing is provided in the containment lip to facilitate movement of paint and retaining of paint within the paint containment chamber.

It is an object of the present invention to provide a drip shield means for use with paint cans wherein the adhesive layer can extend onto the upper surface of the containment lip area to facilitate usage with over-sized paint cans.

It is an object of the present invention to provide a drip shield means for use with paint cans wherein attachment with respect to the paint can by the drip shield will be maintained even when the paint can is moved from one location to another.

It is an object of the present invention to provide a drip shield means for use with paint cans wherein maintenance costs are minimized.

It is an object of the present invention to provide a drip shield means for use with paint cans wherein initial cost is very low.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
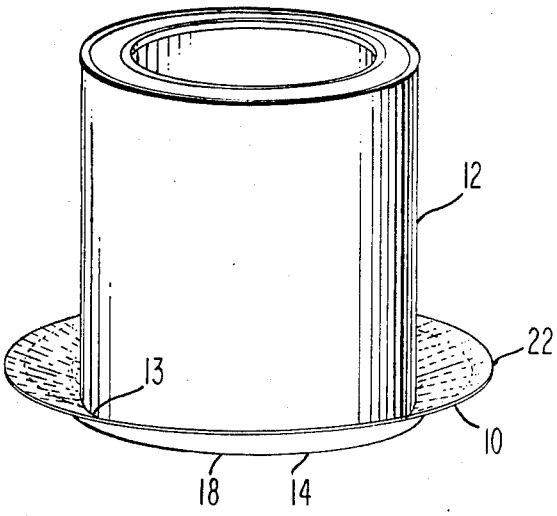
FIG. 1 is a front plan view of an embodiment of the drip shield means of the present invention shown secured with respect to the bottom of a conventional paint can.
Figure 2:
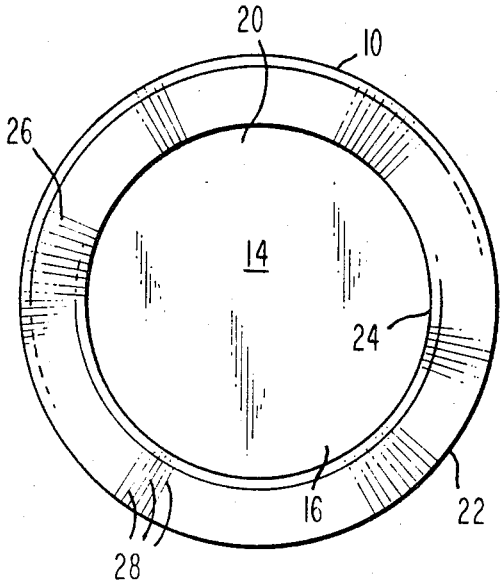
FIG. 2 is a top plan view of the embodiment of the invention set forth in FIG. 1.
Figure 3:
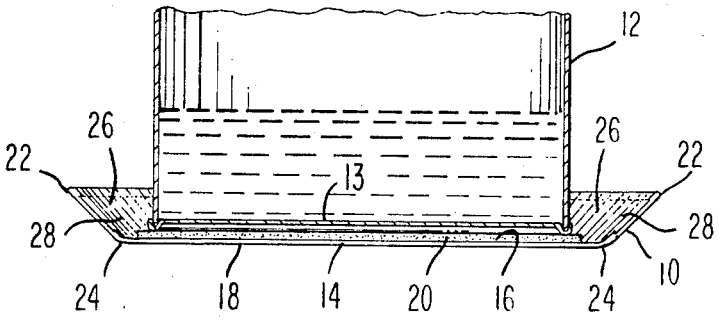
FIG. 3 is a side cross-sectional view of the embodiment set forth in FIG. 1.

The present invention provides a drip shield 10 for use with a paint can 12 as shown in FIGS. 1 and 3. Paint can 12 is adapted to contain paint 11 therein. The drip shield 10 is adapted to be secured with respect to the bottom 13 of paint can 12 in such a manner as to contain paint 11 within the drip shield 10 and prevent spilling onto the surrounding environment.

Drip shield 10 preferably includes a base section 14 adapted to be detachably adhered to the bottom 13 of paint can 12. This securement is made possible by an adhesive means 20 which is preferably pressure-sensitive. Adhesive means 20 is applied across the upper abutment surface 16 of base section 14. Basically upper abutment surface 16 will preferably define the entire upper surface of base section 14 such that pressure-sensitive adhesive means 20 extends across the entire upper abutment surface 16 which is the entire upper surface of base section 14.

Preferably the drip shield 10 will also include a containment lip means 22 extending upwardly and outwardly with respect to the peripheral or circumferential edge 24 which is the outermost edge of base section 14. By extending upwardly and outwardly the containment lip means 22 will define a paint containment chamber 26 in cooperation with the base section 14 which will include as an innermost wall thereof the outer side of paint can 12. The paint containment chamber 26 will be adapted to receive and retain any paint which may run down the outward sides of the paint can. This containment chamber will be generally wedge-shaped and will be capable of receiving and retaining a significant amount of dripping.

Figure 4:
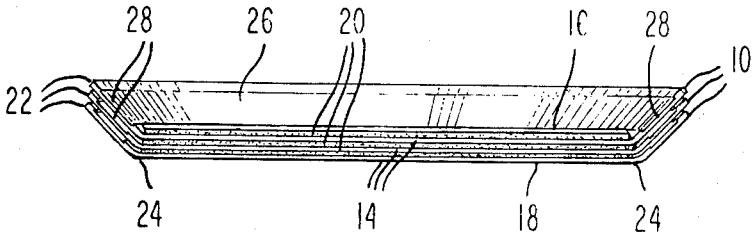
FIG. 4 is a side cross-sectional view of an embodiment of the drip shield means of the present invention shown in stacked position with respect to similarly configured drip shield means.

Drip shield means 10 preferably should be configured to be capable of being self-stacking. That is, drip shield 10 should be capable of being stacked with respect to another drip shield 10 making use of the same adhesive layer 20 on the upper abutment surface 16 of base section 14. As shown in FIG. 4 the placement of any number of drip shields 10 immediately above one another will allow securement of the upper abutment surface 16 with respect to the lower abutment surface 18 through the detachable pressure-sensitive adhesive means 20. This self-stacking capability will allow for shipment in the stacked positions as well as allowing for storage by the user prior to usage thereof in the stacked orientation. This stacked configuration is particularly useful when the drip shield means is made of a paper material such as to be disposable. Drip shield means 10 made of paper will tend to be inexpensive and disposable and thereby most adapted to supply and store in the stacked orientation shown best in FIG. 4.

In order to further facilitate the movement of paint 11 into the paint containment chamber 26 a vertical ribbing means 28 may be included defined in the containment lip means 22 in such a manner as to guide paint 12 downwardy toward the bottom area of paint containment chamber 26. These ribs may extend upwardly and outwardly with respect to the outermost edge 24 of base section 14.

In operation the present invention is utilized by removing a single drip shield 10 from the stack thereof as shown in FIG. 4. Removal of the drip shield 10 is made possible by merely grasping an edge of the containment lip means 22 and lifting upwardly to detach the pressure-sensitive adhesive 20 and remove a single drip shield from the stack.

The user will then take a paint can 12 and place it centrally located onto the drip shield 10 in such a manner that the bottom 13 of paint can 12 contacts the adhesive means 20 extending over the base section 14 and possibly also over a portion of the containment lip means 22. With this configuration the adhesive means 20 will cause the bottom 13 of paint can 12 to adhere to the base section 14 of drip shield 10 to define the paint containment chamber 26 extending circumferentially about the wall of the paint can. This containment chamber will now be in position to receive and retain therein paint drippings running down the outside wall of the conventionally configured paint can. If the user wishes to change location the simple movement of the paint can 12 from one location to another will be possible while still maintaining the detachable securement of the drip shield with respect to the paint can 12. This can be done any number of times while the user is moving along the surface to be painted. However when it is desired to remove and discard the drip shield 10 a downward pressure exerted by the user while holding the paint can will easily detach the drip shield from the paint can. The drip shield can then be disposed of conventionally and a new drip shield can be utilized if desired. This detachable characteristic of the drip shield greatly facilitates usage with paint cans of various sizes and during various types of usage thereof.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A drip shield means, being self-stacking and usable with paint cans of conventionally available sizes, comprising:

(a) a base section being generally circular in shape and extending horizontally to define an upper abutment surface for contacting the bottom of a paint can for detachable securement thereto;

(b) a pressure-sensitive adhesive means positioned extending across the entire upper abutment surface of said base section to facilitate detachable securement of the bottom of a paint can with respect to said drip shield means, said pressure-sensitive adhesive means further being detachably securable with respect to the undersurface of another similarly configured drip shield means to facilitate stacking thereof; and (c) a containment lip means attached circumferentially about the outermost edge of said base section and extending upwardly and outwardly with respect to said base section to define a paint containment chamber to receive and retain paint spilled adjacent the paint can, said containment lip means being in direct abutment with respect to said base section therearound to prevent fluid flow downward therebetween.

2. The drip shield means as defined in claim 1 wherein said base section and said containment lip means are integral with respect to one another.

3. The drip shield means as defined in claim 1 wherein said base section and said containment lip means are made of paper material.

4. The drip shield means as defined in claim 1 wherein said pressure-sensitive adhesive means extends at least partially across the upper surface of said containment lip means to facilitate detachable securement of a paint can with respect to said drip shield means.

5. The drip shield means as defined in claim 1 wherein said containment lip means includes vertical ribbing mans thereon to facilitate the movement of gathered spilled paint into said paint containment chamber.

6. The drip shield means as defined in claim 1 wherein said base section defines a lower abutment surface adapted to be detachably secured with respect to said pressure-sensitive adhesive means of another of said drip shield means to facilitate stacking thereof for shipping and storage.

7. The drip shield means as defined in claim 4 wherein said pressure-sensitive adhesive means extends across the entire upper surface of said containment lip means to facilitate detachable securement of a paint can with respect to said drip shield means.

8. A drip shield means, being self-stacking and usable with paint cans of conventionally available sizes, comprising:

(a) a base section of paper material being generally circular in shape and extending horizontally to define an upper abutment surface for contacting the bottom of a paint can for detachable securement thereto, said base section further including a lower abutment surface over the lowermost side thereof;

(b) a pressure-sensitive adhesive means positioned extending across the entire upper abutment surface of said base section to facilitate detachable securement of the bottom of a paint ca with respect to said drip shield means, said pressure-sensitive adhesive means further being detachably securable with respect to said lower abutment surface of another similarly configured drip shield means to facilitate stacking prior to usage thereof; and (c) a containment lip means of paper material being circumferentially integral with the outermost edge of said base section and extending upwardly and outwardly with respect to said base section to define a paint containment chamber to receive and retain paint spilled adjacent the paint can, said containment lip means further defining a plurality of vertical ribbing means thereon to facilitate the movement of gathered spilled paint into said paint containment chamber, said containment lip means being in direct abutment with respect to said base section therearound to prevent fluid flow downward therebetween.

* * * * *